US008066165B2

(12) United States Patent
Ishizawa et al.

(10) Patent No.: US 8,066,165 B2
(45) **Date of Patent: *Nov. 29, 2011**

(54) FASTENER DRIVING TOOL

(75) Inventors: Yoshinori Ishizawa, Ibaraki (JP); Hiroki Kitagawa, Ibaraki (JP); Masashi Nishida, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/140,468

(22) Filed: Jun. 17, 2008

(65) Prior Publication Data

US 2008/0251566 A1 Oct. 16, 2008

Related U.S. Application Data

(63) Continuation of application No. 11/176,290, filed on Jul. 8, 2005, now Pat. No. 7,441,683.

(30) Foreign Application Priority Data

Jul. 9, 2004 (JP) ..... P2004-203682

(51) Int. Cl.
*B25C 1/18* (2006.01)

(52) U.S. Cl. ..... 227/110; 227/120; 227/121; 227/135; 227/136; 227/137; 227/8; 227/109

(58) Field of Classification Search ..... 227/8, 120, 227/121, 135, 136, 137, 109
See application file for complete search history.

(56) References Cited

U.S. PATENT DOCUMENTS

| | | | | |
|---|---|---|---|---|
| 3,615,049 | A | 10/1971 | Obergfell et al. | |
| 3,858,781 | A | 1/1975 | Obergfell et al. | |
| 4,630,766 | A * | 12/1986 | Steeves et al. | 227/8 |
| 5,163,596 | A | 11/1992 | Ravoo et al. | |
| 5,322,189 | A | 6/1994 | Oda | |
| 5,335,800 | A | 8/1994 | Liu | |
| 5,433,367 | A | 7/1995 | Liu | |
| 5,626,274 | A | 5/1997 | Shkolnikov et al. | |
| 5,816,469 | A * | 10/1998 | Ohuchi | 227/119 |
| 6,053,389 | A | 4/2000 | Chu et al. | |
| 6,056,181 | A | 5/2000 | Chuang | |
| 6,199,739 | B1 | 3/2001 | Mukoyama et al. | |
| 6,290,115 | B1 | 9/2001 | Chen | |
| 6,431,428 | B1 | 8/2002 | Chen | |
| 6,592,014 | B2 | 7/2003 | Smolinski | |
| 6,641,022 | B2 | 11/2003 | Hamano et al. | |

(Continued)

FOREIGN PATENT DOCUMENTS

JP 2000-015589 1/2000

(Continued)

*Primary Examiner* — Paul R. Durand
*Assistant Examiner* — Michelle Lopez
(74) *Attorney, Agent, or Firm* — McDermott Will & Emery LLP

(57) ABSTRACT

A clearance is set between a nail feeder and an outer profile portion so that the nail feeder can turn. A pin as a first restriction member that inhibits movement of the nail feeder to an ejection portion by engaging with the nail feeder and can release the engagement with the rotation of the nail feeder is provided to the outer profile portion. The position at which the nail feeder and a spring engage is set in deviation from the position at which the nail feeder and the pin engage, in a reciprocating direction of the nail feeder and in a vertical direction.

8 Claims, 11 Drawing Sheets

U.S. PATENT DOCUMENTS 6,772,931 B2 8/2004 Miller et al.
6,938,809 B1 9/2005 Schnell
7,032,794 B1 4/2006 Hung et al.
7,441,683 B2 * 10/2008 Ishizawa et al. ..... 227/120
2006/0102683 A1 * 5/2006 Schnell et al. ..... 227/119

FOREIGN PATENT DOCUMENTS

JP 2000-334680 12/2000

* cited by examiner

FASTENER DRIVING TOOL

This application is a continuation application of U.S. application Ser. No. 11/176,290 filed Jul. 8, 2005, now U.S. Pat. No. 7,441,683, the entirety of which is incorporated herein by reference.

BACKGROUND OF THE INVENTION

1. Field of the Invention

This invention relates to a fastener driving tool that uses compressed air or gas. More particularly, the invention relates to a structure of a magazine for storing fastening members such as nails.

2. Description of the Related Art

When fastening members such as nails clog inside a fastener driving tool, the clogging fastening members must be removed. Hereinafter, associated technologies will be explained.

FIG. 9 shows a construction described in JP-A-2000-15589. A hole 5 is bored in a guide wall 4 of a magazine 3 and a hook member 6 is inserted. When the hook member 6 and a nail feeder 2 engage, the movement of the nail feeder 2 towards a nail ejection portion 7 can be inhibited. Consequently, when the nail 14 clogs inside an ejection port 23, the nail feeder 2 is hooked at an intermediate portion of the magazine 3 and the magazine is opened. The clogging nail can thus be removed.

FIG. 10 shows a construction described in JP-A-2000-334680. In this construction, a part of the nose 11 can open. A door member 12 rotates round a rotary shaft 13 as its center and can be opened and closed arbitrarily. When clogging of the nail occurs, the clogging nail 14 inside the ejection port 23 can be removed.

FIG. 11 shows a construction in which a protuberance portion 10 is provided to a fitting portion 9 of a feeder spring 8 to the magazine 3 and the nail feeder 2 is hooked to this protuberance portion 10. According to this construction, the magazine 3 can be removed from the main body of the fastener driving tool 1 when nail clogging or operation defect of the nail feeder 2 occurs but when the magazine 3 is removed, the nail feeder 2 engages with the protuberance portion 10 and cannot be removed from the magazine 3.

SUMMARY OF THE INVENTION

When the nail clogs in the proximity of the ejection port, JP-A-2000-15589 (FIG. 9) involves the problem that even when the nail feeder is moved from the nose towards the nail loading port side and the magazine is partly opened, the nail cannot be removed if it undergoes deformation such as bending at the depth of the ejection port. Furthermore, it is necessary at the time of assembly to fit the magazine to the main body while the nail feeder is held against the push force of the feeder spring lest the nail feeder falls off from the magazine.

When the construction in which the nose is partly opened as described in JP-A-2000-334680 (FIG. 10) is employed, the problems occur in that the number of components increases, the construction gets complicated and the weight and the cost rise.

When the construction shown in FIG. 11 is employed, the problem occurs that the feeder spring and the protuberance portion must be disassembled to remove the nail feeder, and this operation is troublesome.

It is an object of the invention to provide a fastener driving tool equipped with a magazine that can solve the problems of the prior art described above and can be easily fitted, removed and disassembled.

The invention provides a fastener driving tool comprising a driver blade for striking a fastening member such as a nail; an ejection portion for guiding the driver blade; and a magazine for supplying the fastening members to the ejection portion, including an outer profile portion for accommodating the fastening members in such a manner as to be capable of sliding towards the ejection portion, a nail feeder for pushing the fastening member towards a nose portion, and a spring for pushing the nail feeder towards the ejection portion; wherein a clearance is set between the nail feeder and the outer profile portion so that the nail feeder can rotate, a first restriction member inhibiting the movement of the nail feeder to the ejection portion upon engaging with the nail feeder and capable of releasing the engagement when the nail feeder rotates is provided to the outer profile portion, and a position at which the nail feeder and the spring engage with each other is set to a position different from a position at which the nail feeder and the first restriction member engage with each other, in a direction perpendicular to a reciprocating direction of the nail feeder on a plane on which the nail feeder rotates. According to this construction, when the hand is released while the nail feeder keeps the engagement with the first restriction member, the spring pushes the nail feeder in the rotating direction with the position of the engagement with the first restriction member as the center, and the nail feeder gets stabilized while keeping the contact state with the first restriction member and the guide wall. Therefore, each component does not get disassembled even under the state where the magazine is removed from the ejection portion. To disassemble, the nail feeder is rotated in an opposite direction against the push force of the spring. Then, the engagement of the nail feeder with the first restriction member is released and the nail feeder becomes movable and can be removed.

The invention provides also the fastener driving tool described above, wherein a second restriction member coming into contact with the nail feeder while the magazine is fitted to the ejection portion, coming into contact obliquely in the reciprocating direction of the nail feeder and pushing the nail feeder in an approaching direction to the first restriction member is provided to the ejection portion. According to this construction, the nail feeder automatically engages with the first restriction member and gets stabilized when the magazine is removed from the ejection portion. Therefore, it is possible to prevent each component from accidentally getting disassembled.

According to the construction of claim 1, when the hand is released while the nail feeder keeps engagement with the first restriction member, the nail feeder gets stabilized while keeping the contact state with the first restriction member and the guide wall. Therefore, each component does not get disassembled even under the state where the magazine is removed from the ejection portion. To disassemble, the nail feeder is rotated in the opposite direction against the push force of the spring. Then, the engagement of the nail feeder with the first restriction member is released and the nail feeder becomes movable and can be removed. Consequently, the invention can provide a fastener driving tool having the magazine that can be easily fitted, removed and disassembled.

According to the construction of claim 2, when the magazine is removed from the ejection portion, the nail feeder automatically engages with the first restriction member and gets stabilized when the magazine is removed from the ejection portion. Therefore, it is possible to prevent each component from accidentally getting disassembled.

DETAILED DESCRIPTION OF THE PREFERRED EMBODIMENTS

Figure 1:
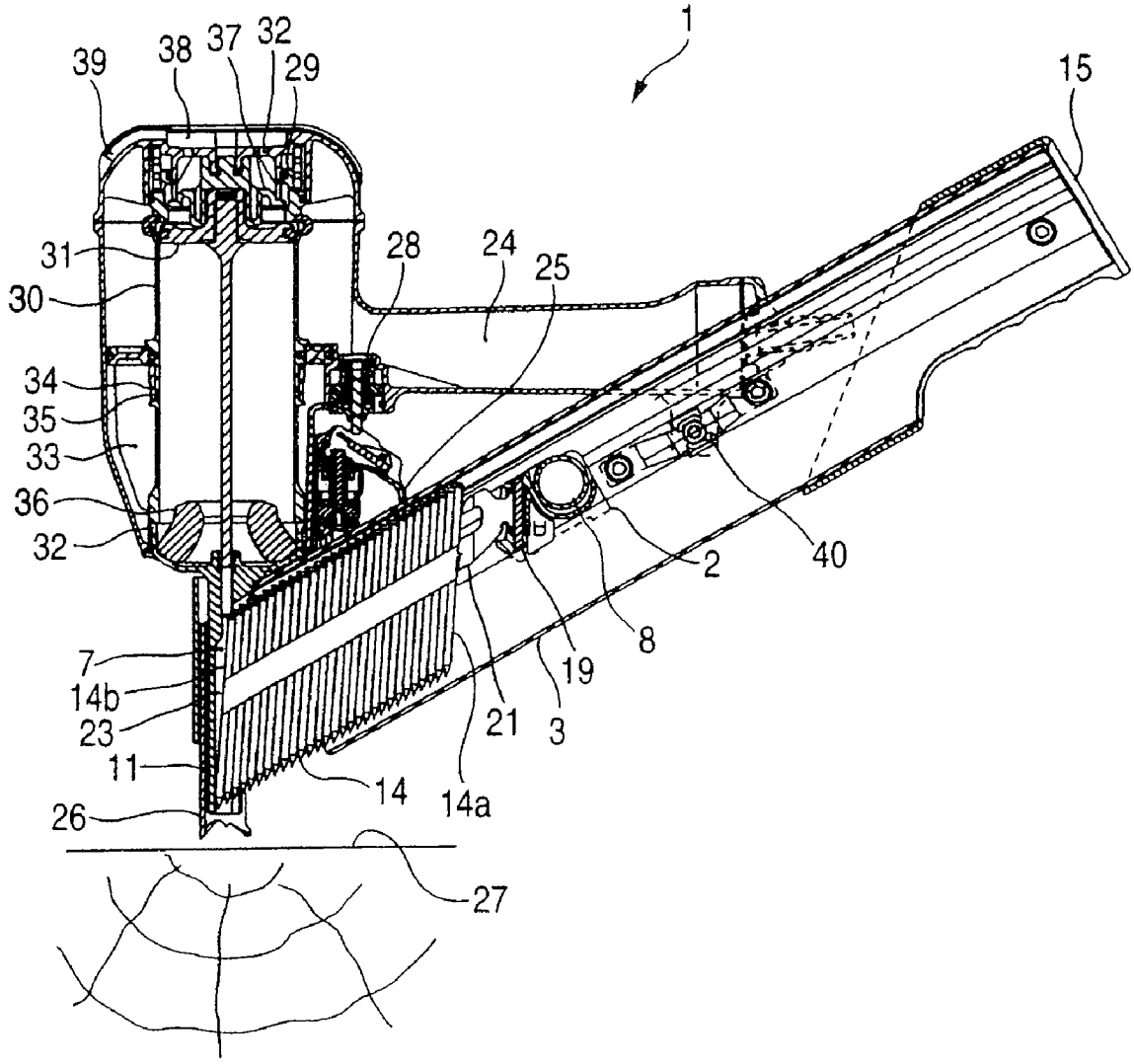
FIG. 1 is an overall structural sectional view of a fastener driving tool according to an embodiment of the invention.

A fastener driving tool 1 according to the invention will be explained with reference to FIG. 1 to FIG. 8.

A nail feeder 2 will be explained with reference to FIG. 1 to FIG. 4.

Loading of nails 14 that are interconnected substantially parallel to one another by paper, plastic, etc., is made from a nail loading port 15 that opens on a rear end face of a magazine 3. The sectional shape of the magazine 3 in a direction orthogonal to the nail (14) feeding direction is as follows in order to keep the nails 14.

Figure 4:
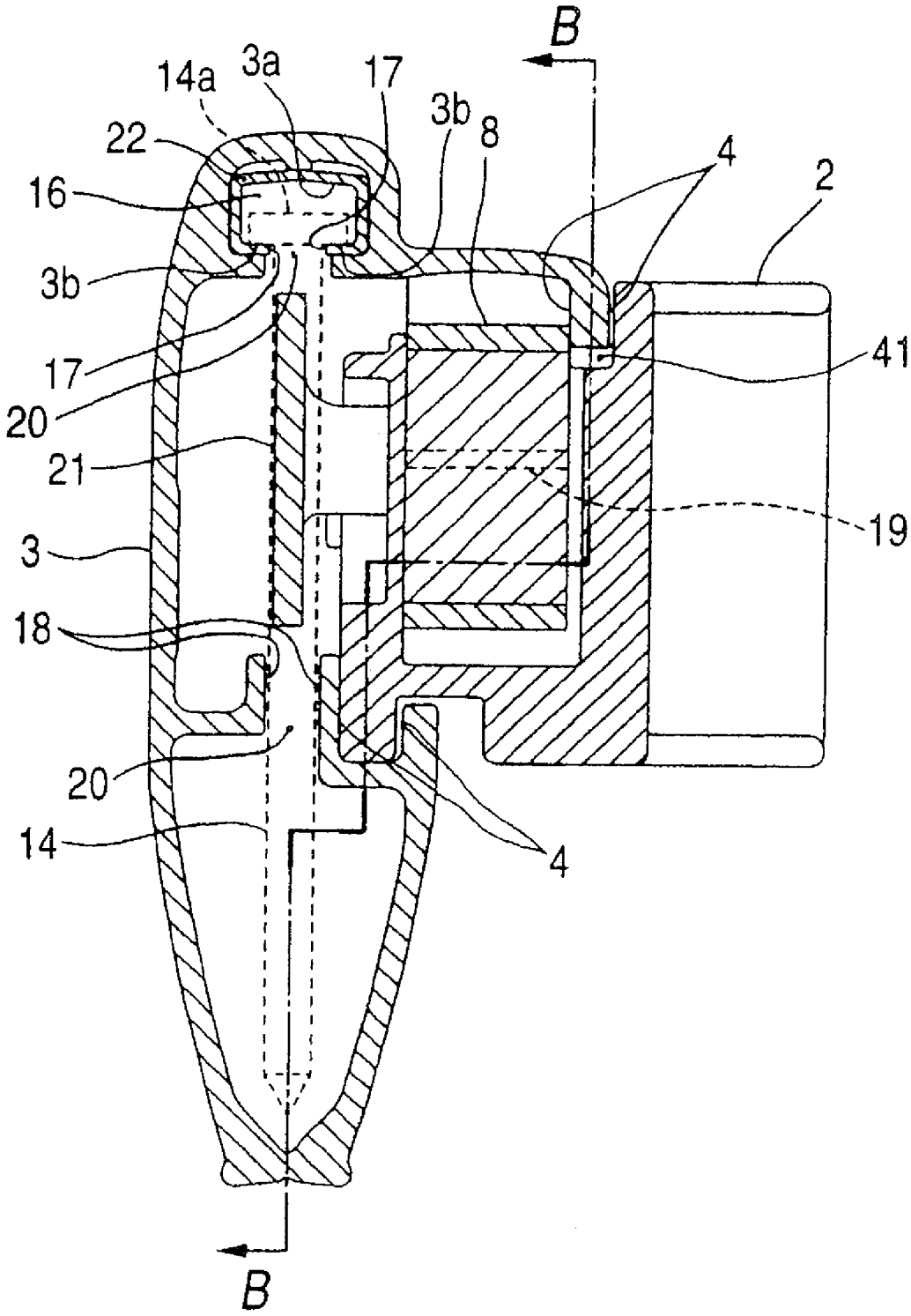
FIG. 4 is a sectional view taken along a line A-A in FIG. 2 and shows the state where a nail feeder engages with a pin.

In the upper direction in FIG. 4, the upper side of a nail head 14*a* is held by the upper surface of a guide groove 16. In the lower direction, the lower side of the nail head 14*a* is held by both sides 3*b* of the lower surface of the guide 16. In the transverse direction, the upper part of the nail 14 is held by a guide (A) 17 immediately below the lower surface and the lower part of the nail 14 is held by a guide (B) 18 at a substantial center of the magazine 3.

Guide grooves are arranged at the upper and lower two positions of the magazine 3 so that the nail feeder 2 can reciprocate towards the ejection portion 7. A feeder spring 8 having a rotary shaft 19 in an orthogonal direction to a nail axis, for pushing the nail 14 towards the ejection portion 7 and a nail feeder (A) 21 pushed towards the ejection portion 7 by the feeder spring 8 are provided to the nail feeder 2. The nail feeder (A) 21 is constituted in such a manner as to be rotated by the nail 14 with the rotary shaft 42 as its center and to retreat from the guide groove 20 after the nails 14 are loaded from the nail loading port 15 at the rear end of the magazine 3, and to again protrude into the guide groove 20 owning to the push force of the spring 43 after it gets over the nail 14.

The outer profile portion of the magazine 3 is extrusion molded from a non-ferrous metal such as aluminum or magnesium. Nail rails of iron are arranged on both sides of the guide groove 20 through which the nail head 14*a* passes, to prevent wear.

Figure 5:
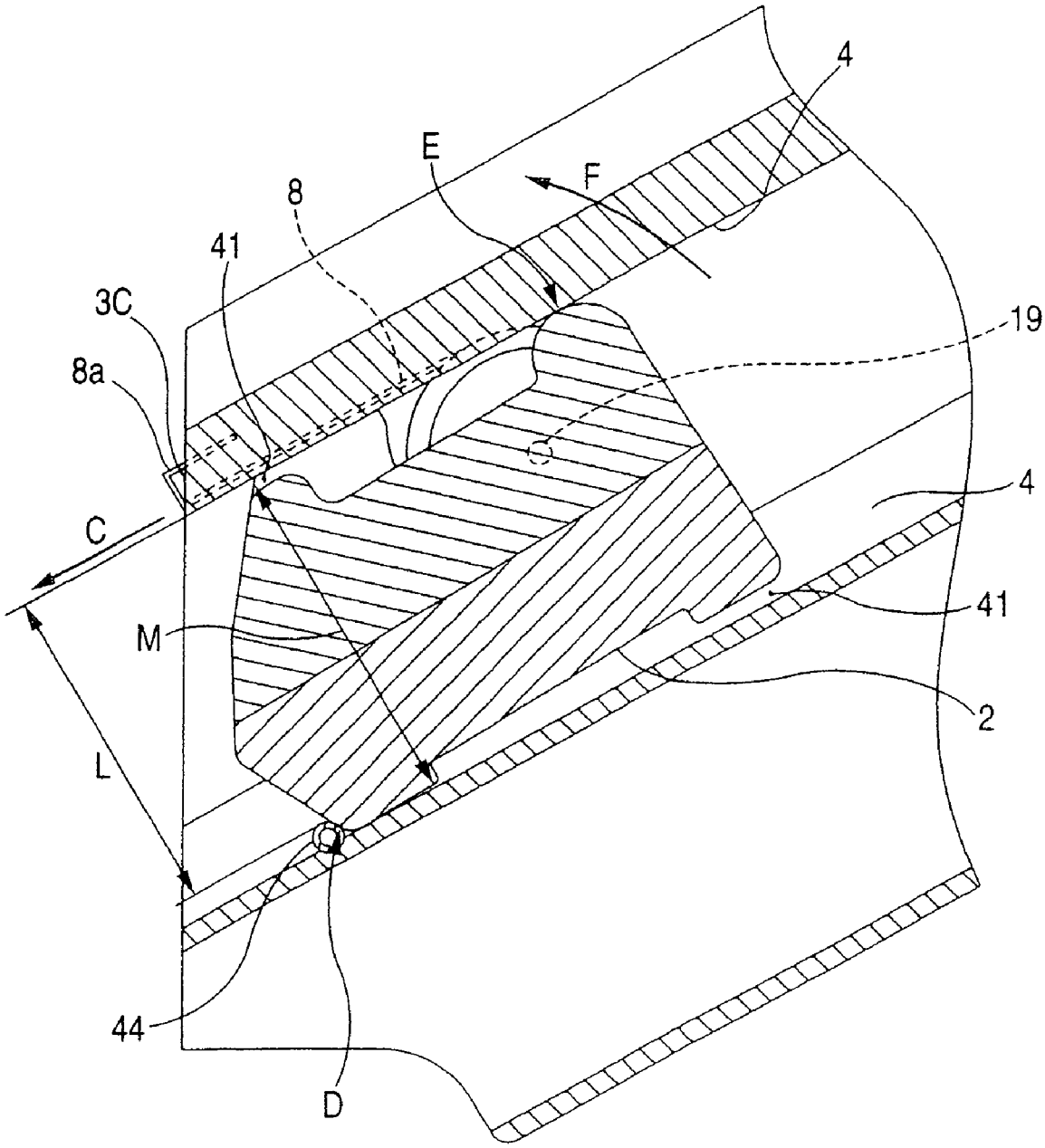
FIG. 5 is a sectional view taken along a line B-B in FIG. 4 and shows the state where the nail feeder engages with the pin.

The nail feeder 2 is guided by the guide wall 4 of the magazine 3 in such a manner as to slide in the feeding direction of the nails 14. As shown in FIG. 5, the height M of the nail feeder 2 is so set as to be greater than the distance L between the guide wall 4 and a pin 44 so that the nail feeder 2 can slightly rotate when viewed from the front surface.

A feeder spring 8 is provided to the nail feeder 2 so that it can rotate with a rotary shaft 19 at its center. The rotary shaft 19 as a position at which the feeder spring 8 and the nail feeder 2 engage is set to a position closer to the guide wall 4 on the upper side than an intermediate point of the opposing guide groove formed by the guide wall 4 on the lower side. The distal end 8*a* of the feeder spring 8 is hooked to a distal end face 3*c* close to the upper guide wall 4. Holes 5 are bored in the lower guide groove formed by the guide wall 4 on the lower side in a depth-wise direction and a pin 44 is inserted into this hole 5. In FIG. 5, the nail feeder 2 is under the following state. In other words, the nail feeder 2 keeps contact with the pin 44 at a point D at a lower part and is pushed by the feeder spring 8 towards the ejection portion 7 at the fitting position of the rotary shaft 19. Consequently, the nail feeder 2 rotates in an F direction with the D point as the center and remains stable at an upper E point while keeping contact with the upper guide groove 4. Therefore, the pin 44 operates as a restriction member.

Next, the operation of the nail feeder 2 will be explained.

Figure 2:
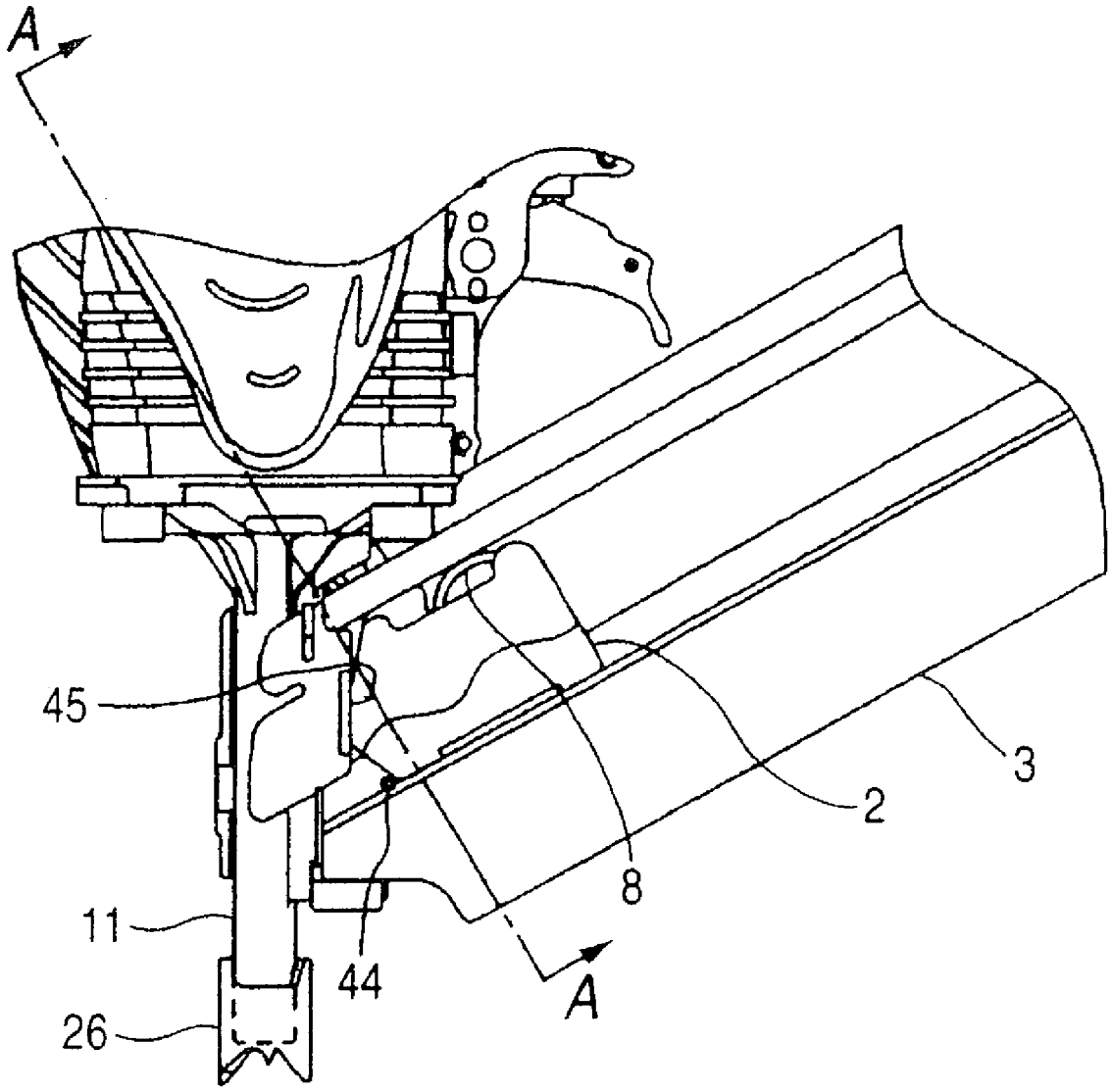
FIG. 2 is an appearance view of principal portions of the fastener driving tool according to the embodiment of the invention.
Figure 3:
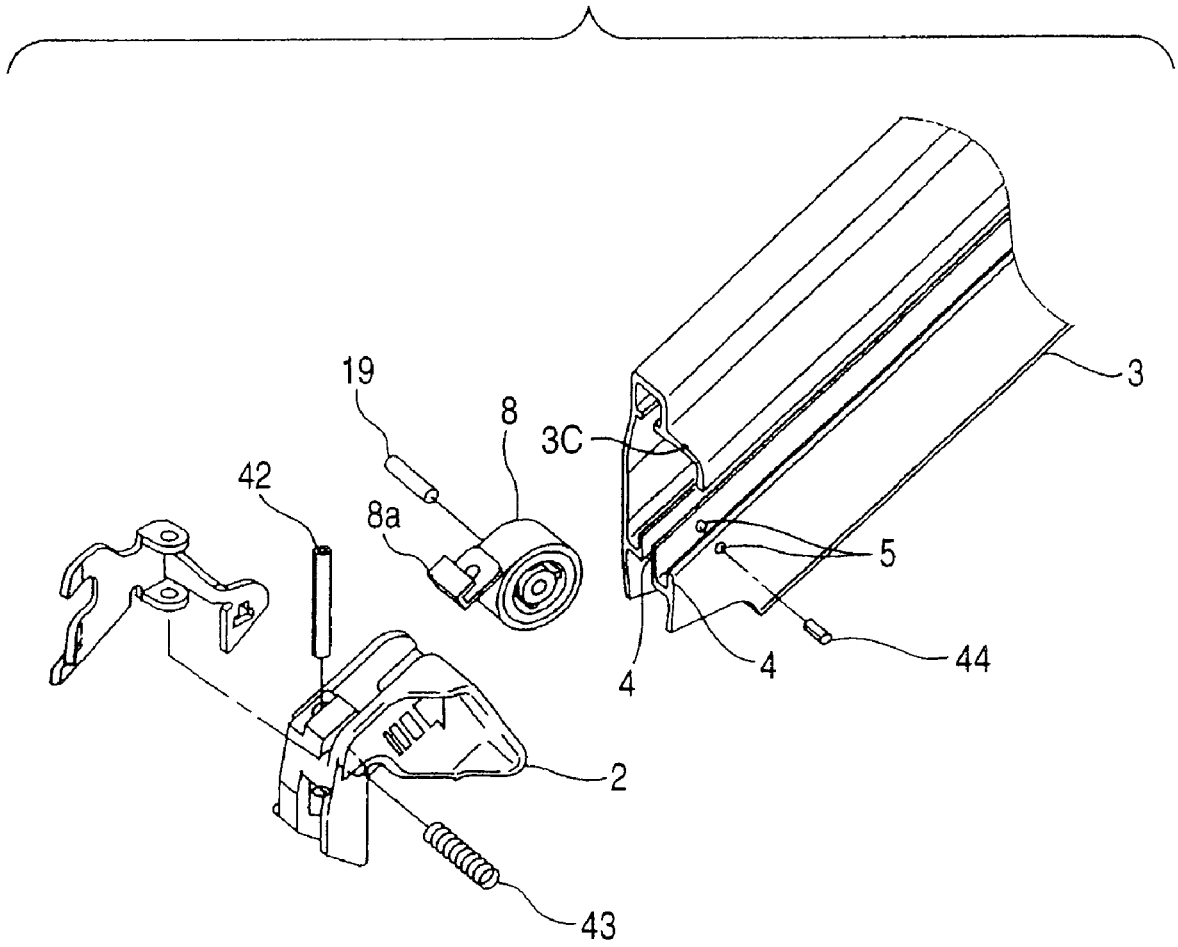
FIG. 3 is an exploded perspective view of the principal portions of the fastener driving tool according to the embodiment of the invention.

When the nail is not loaded into the magazine 3, the nail feeder 2 keeps contact with a contact portion 45 of the nose 11 as shown in FIG. 2 and the nail feeder 2 and the pin 44 are out of contact from each other. The surface of the contact portion 45 with which the nail feeder 2 comes into contact is substantially parallel to the extending direction of the nose 11 and is so formed as to describe an acute angle with a guide surface on the lower side. In other words, this surface is inclined with respect to the reciprocating direction of the nail feeder 2. Consequently, force acts on the nail feeder 2 in the direction of the guide surface on its lower side and in a direction approaching the pin 44. The contact portion 45 operates as a second restriction member.

When the magazine 3 is removed from the fastener driving tool 1, the nail feeder 2 comes into contact with the pin 44 and enters the state shown in FIGS. 4 and 5 described above substantially simultaneously when the contact portion 45 and the nail feeder 2 separate from each other. The nail feeder 2 is pushed by the feeder spring 8 in the C direction as already described but engages with the pin 44, forming a clearance 41 at the position shown in the drawings. Because the rotary shaft 19 of the feeder spring 8 exists at a position deviated towards the nail head 14*a*, turning force in the F direction and the nail feeder 2 and the magazine 3 keep contact at the D and E points.

The feeder spring 8 pushes the nail feeder 2 towards the ejection portion 7 and the nail feeder 2 pushes the nail group 14 towards the ejection portion 7. The nails 14 are thus supplied to the ejection portion 7. As the nails 14 are driven one after another by the driving operation, the nail group 14 becomes shorter and the nail feeder 2 serially moves towards the ejection portion 7. At this time, too, the nail feeder 2 is to rotate in the F direction by the operation of the feeder spring 8 and slides along the guide wall 4 while keeping the contact state with the guide wall 4 at the D and E points.

The nail 14 sometimes clogs in the proximity of the ejection portion during the driving operation. In such a case, the screw 40 that fixes the magazine 3 is removed and the magazine 3 is removed from the ejection portion 7. The nail feeder 2 is held by hand in this instance lest it jumps out. After the magazine 3 is removed and the nail group 14 inside the magazine 3 is then removed, the nail feeder 2 is twisted in the F direction and is returned to the state where it comes into contact with the pin 44, that is, the state shown in FIG. 5. Each component does not break up into pieces under this state. When the nail clogs inside the ejection portion 7, the nail 14 is removed from the ejection portion 7.

Figure 6:
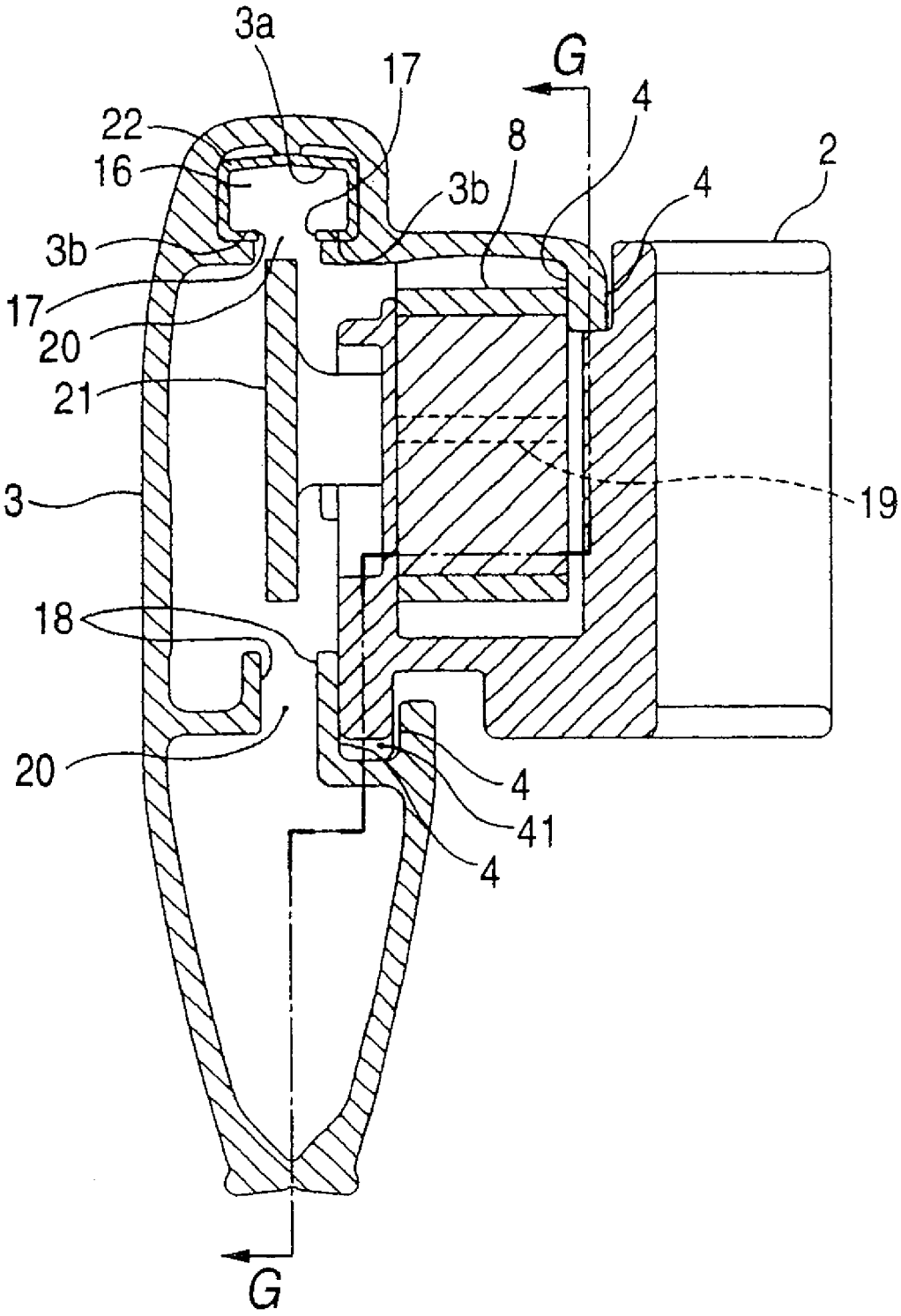
FIG. 6 is a sectional view taken along the line A-A in FIG. 2 and shows the state where engagement between the nail feeder with the pin is released.
Figure 7:
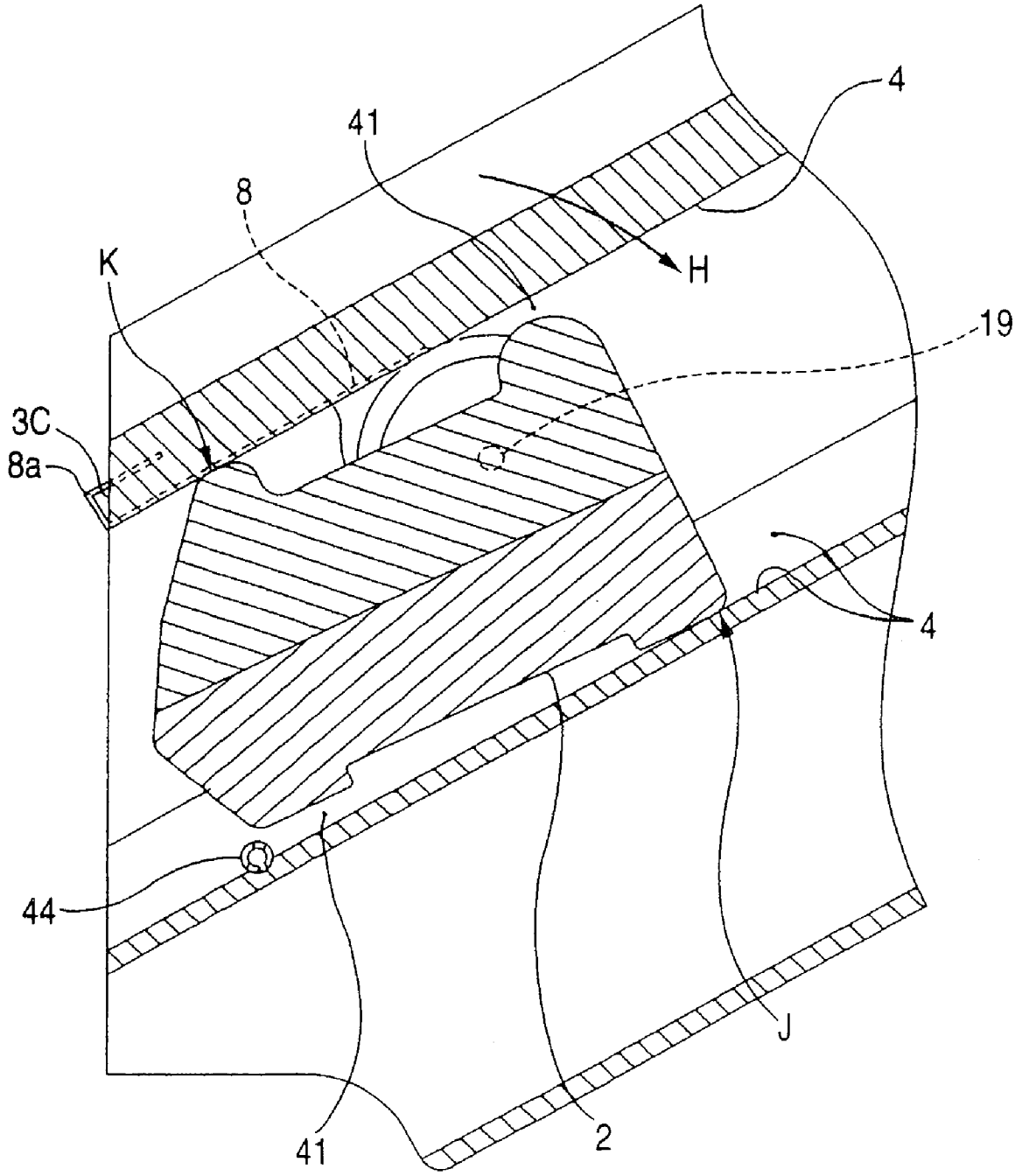
FIG. 7 is a sectional view taken along the line G-G in FIG. 6 and shows the state where engagement between the nail feeder and the pin is released.
Figure 8:
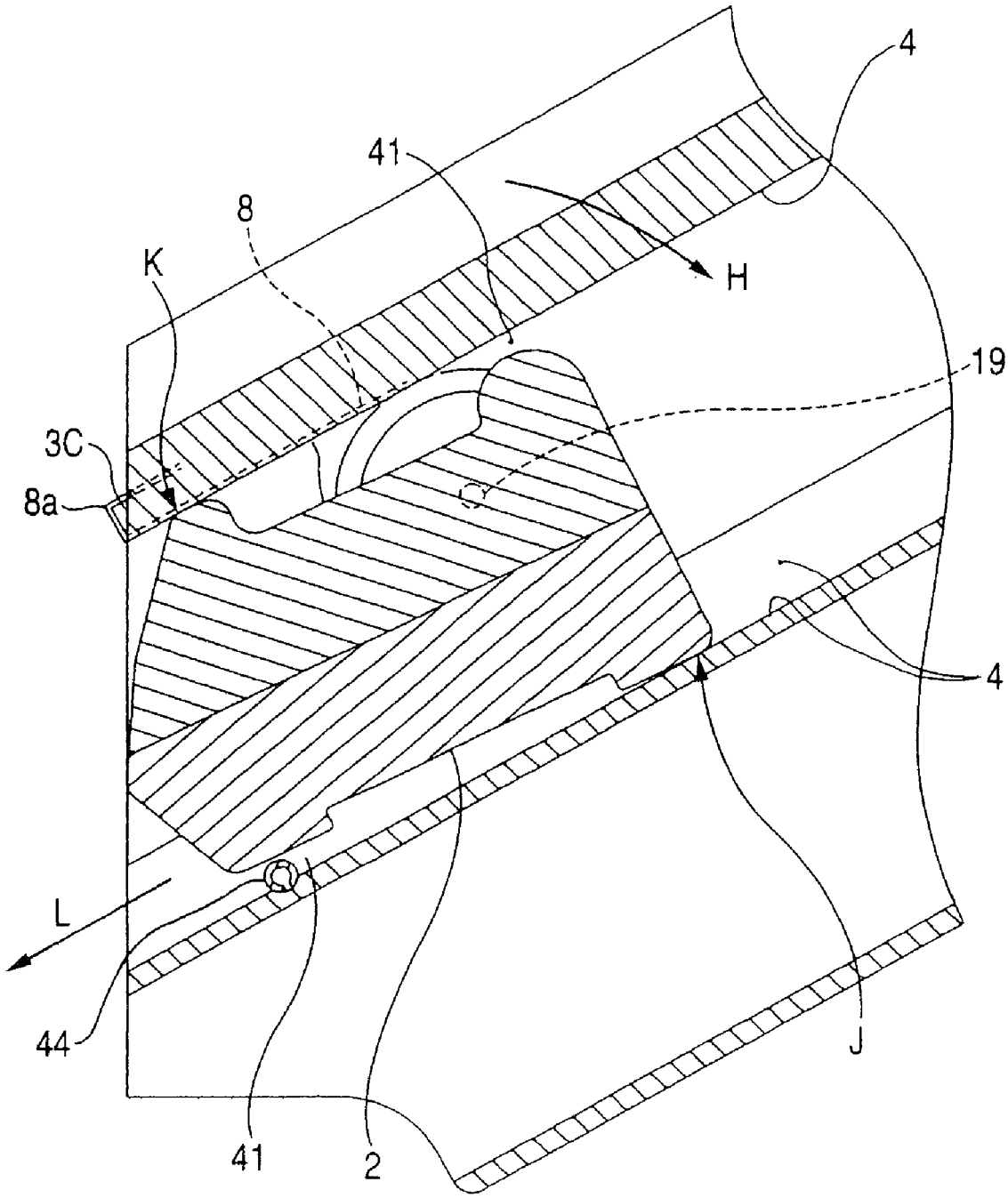
FIG. 8 is a view showing the state where the nail feeder moves from the state shown in FIG. 7.
Figure 9:
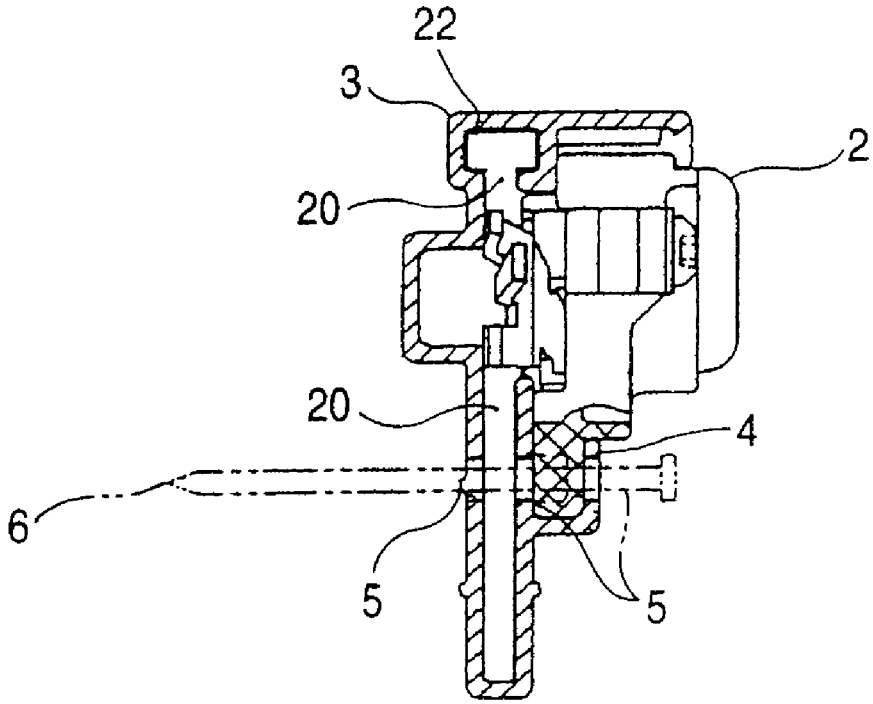
PRIOR ART FIG. 9
FIG. 9 is a sectional view showing principal portions of a fastener driving tool described in JP-A-2000-15589.
Figure 10:
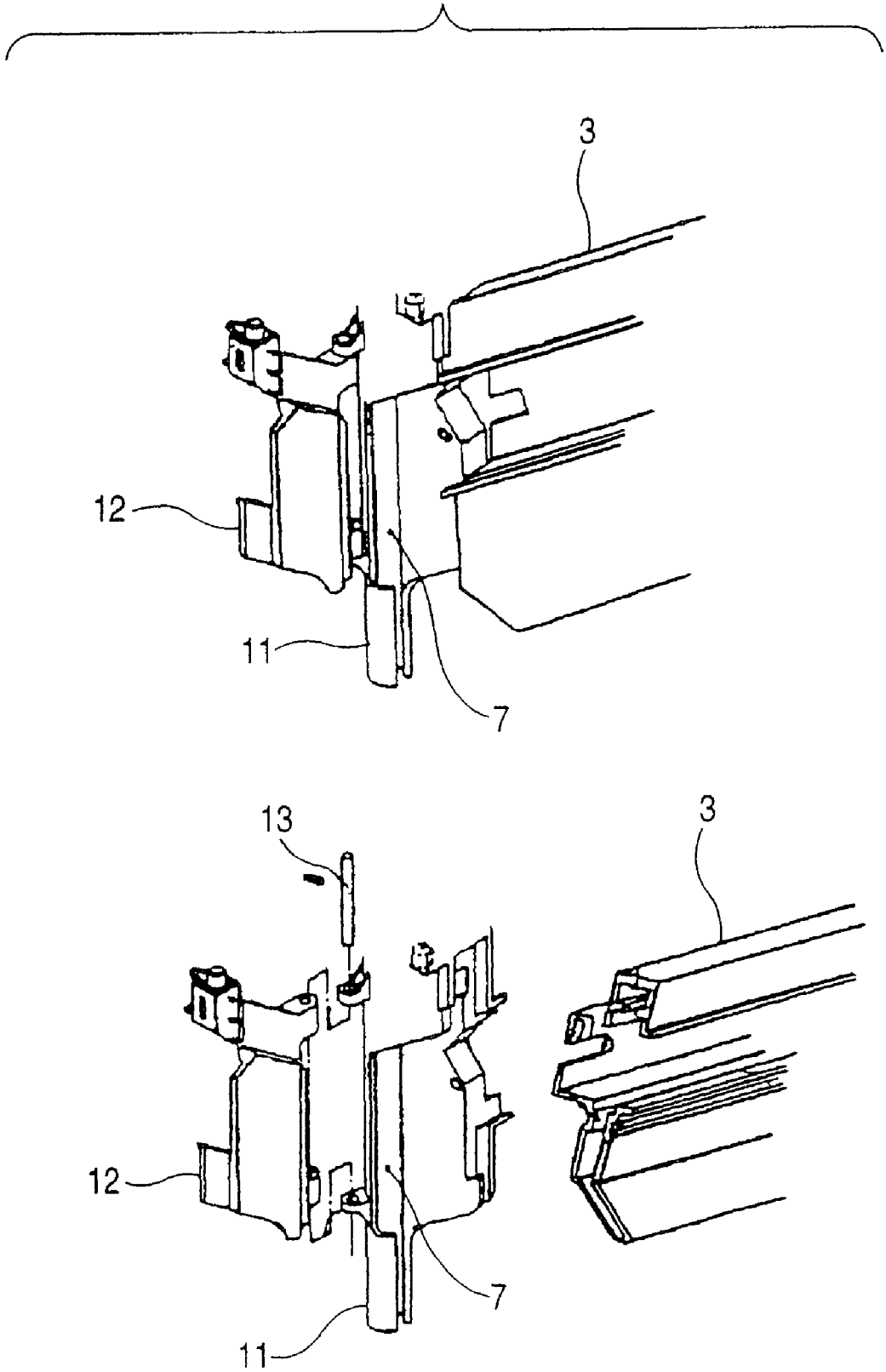
PRIOR ART FIG. 10
FIG. 10 is an exploded sectional view showing principal portions of a fastener driving tool described in JP-A-2000-334680.
Figure 11:
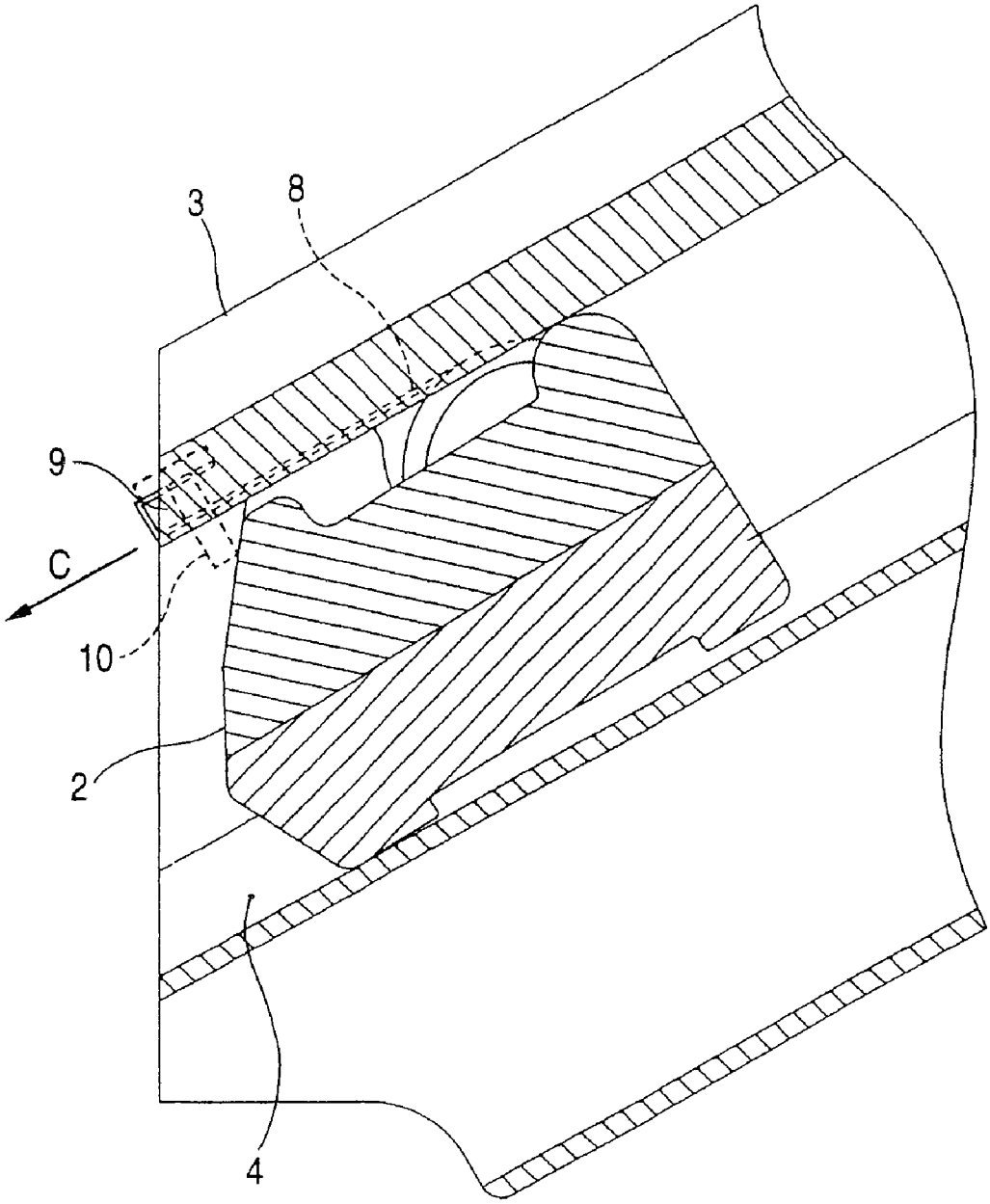
PRIOR ART FIG. 11
FIG. 11 is a sectional view of principal portions of an example of a fastener driving tool according to the prior art.

When it is desired to disassemble the magazine 3 from this state, the nail feeder 2 is rotated in the H direction against the push force of the feeder spring 8 as shown in FIGS. 6 and 7. Consequently, the engagement between the nail feeder 2 and the pin 44 is released and the nail feeder 2 and the guide wall 4 come into contact with each other at the J and K points. The clearance 41 is formed in this case at the position opposite to that of FIG. 5. When the nail feeder 2 is moved in the L direction, the nail feeder 2 moves beyond the pin 44 and can be taken out from the magazine 3.

The driving operation of the fastener driving tool 1 having the construction described above will be explained with reference to FIG. 1.

The nails 14 are loaded from the nail loading port 15 opening to the rear end ace of the magazine 3. While the nail feeder 2 is positioned on the side of the nail loading port 15, the nail feeder (A) 21 is allowed to get over the nail group 14 and is retreated and pulled up until the last nail 14*a* gets over. The nail feeder (A) 21 again protrudes into the guide groove 20. When the hand is released, the nail group 14 is fed toward the ejection portion 7 by the push force of the feeder spring 8 and the first nail 14*b* is loaded to the ejection port 23.

Next, an air hose not shown is connected and compressed air is stored. This compressed air is stored in an accumulation chamber 24.

Both triggering of the trigger 25 and pushing of the push lever 26 to the wood material are carried out and the trigger valve 28 is turned ON. Then, the main valve 29 moves to the upper dead point side and the accumulation chamber 24 and the upper side of the piston 31 inside the cylinder 30 are communicated with each other. The accumulation chamber 24 is cut off from the air passage 32.

While the piston 31 drastically moves towards the lower dead point side owing to compressed air flowing from the accumulation chamber 24 into the upper side of the piston 31 inside the cylinder 30, the nail 14 is driven into the wood material 27. Air staying on the lower side of the piston 31 inside the cylinder 30 is allowed to flow through the air passage 32 into the return chamber 33. When the piston 31 passes by the air passage 35 having the check valve 34 in the direction of the return chamber 33, a part of compressed air on the upper side of the piston 31 is allowed to flow into the return chamber 33 through the air passage 35. The piston 31 comes into contact with the piston bumper 36 and undergoes a deformation at the lower dead point and excessive energy is absorbed.

The main valve 29 moves towards the lower dead point when the trigger 25 is returned or the push operation of the push lever 26 to the wood material 27 is stopped to turn OFF the trigger valve 28.

The main valve 29 is closed and the accumulation chamber 24 is cut off from the upper side of the piston 31 inside the cylinder 30. The exhaust rubber 37 communicates the upper side of the piston 31 inside the cylinder 30 with the atmosphere. Compressed air accumulated in the return chamber 33 pushes the lower side of the piston 31 and the piston 31 drastically moves towards the upper dead point side. Compressed air on the upper side of the piston 31 is emitted to the atmosphere from the exhaust port 39 through the air passage 32 and the expansion chamber 38 and the state returns to the initial state.

The nails interconnected to one another are serially driven into the wood material 27 when this step is repeated.

When the nail 14 cannot be fed normally or is bent during the driving and clogging occurs inside the ejection port 23, the screw 40 is turned and the magazine is removed from the fastener driving tool 1 so that the clogging nail 14 can be removed.

What is claimed is:

1. A fastener driving tool comprising:

a driver blade for striking a fastening member;

an ejection portion for guiding said driver blade;

a magazine attached to the ejection portion and supplying fastening members to said ejection portion, the magazine including an outer profile portion for accommodating said fastening members, a feeder mounted on a rotary shaft for pushing said fastening members towards said ejection portion, and a spring for pushing said feeder towards said ejection portion; and a first restriction member provided at said outer profile portion, the first restriction member inhibiting the movement of said feeder to said ejection portion upon engaging with said feeder when the magazine is removed from the ejection portion;

wherein each of said fastening members has an axis of elongation, wherein a clearance is set between said feeder and said outer profile portion, wherein said rotary shaft of said feeder is orthogonal to said axis of elongation of said fastening members, wherein said feeder rotates between a first position at which said feeder and said restriction member contact with each other and a second position at which said feeder and said restriction member are released from each other, and wherein said rotary shaft at which said feeder and said spring engage with each other is set to a position different from a position at which said feeder and said first restriction member engage with each other, in a direction perpendicular to an advancing direction of said fastening members towards the ejection portion.

2. The fastener driving tool according to claim 1, wherein said rotary shaft is substantially perpendicular to an advancing direction of said fastening members towards the ejection portion.

3. The fastener driving tool according to claim 1, wherein the magazine is made of non-ferrous metal.

4. The fastener driving tool according to claim 1, further comprising an accumulation chamber for storing compressed air.

5. A fastener driving tool comprising:

a driver blade for striking a fastening member;

an ejection portion for guiding said driver blade;

a magazine attached to the ejection portion and supplying fastening members to said ejection portion, the magazine including an outer profile portion for accommodating said fastening members, a feeder mounted on a rotary shaft for pushing said fastening members towards said ejection portion, and a spring for engaging and pushing said feeder towards said ejection portion; and a first restriction member provided at said outer profile portion, the first restriction member inhibiting the movement of said feeder to said ejection portion upon engaging with said feeder when the magazine is removed from the ejecting portion;

wherein each of said fastening members has an elongated structure and an axis of elongation thereof, wherein a clearance is set between said feeder and said outer profile portion wherein said rotary shaft of said feeder is orthogonal to said axis of elongation of said fastening members, wherein said feeder rotates between a first position at which said feeder and said restriction member contact with each other and a second position at which said feeder and said restriction member are released from each other, and wherein said rotary shaft at which said feeder and said spring engage with each other is set to a position different from a position at which said feeder and said first restriction member engage with each other, in a direction perpendicular to an advancing direction of said fastening members towards the ejection portion.

6. The fastener driving tool according to claim 5, wherein said rotary shaft is substantially perpendicular to an advancing direction of said fastening members towards the ejection portion.

7. The fastener driving tool according to claim 5, wherein the magazine is made of non-ferrous metal.

8. The fastener driving tool according to claim 5, further comprising an accumulation chamber for storing compressed air.

* * * * *